US005853353A

United States Patent [19]

Blümel

[11] Patent Number: 5,853,353

[45] Date of Patent: Dec. 29, 1998

[54] ERGOMETRIC STATIONARY EQUIPMENT SUITABLE FOR TRAINING, DIAGNOSTIC OR REHABILITATION PURPOSES

[75] Inventor: Georg Blümel, Leipzig, Germany

[73] Assignee: Bavaria Patente und Lizenzen Verwertungsgesellschaft mbH, Kreischa, Germany

[21] Appl. No.: 844,300

[22] Filed: Apr. 18, 1997

[30] Foreign Application Priority Data

Apr. 18, 1996 [DE] Germany ..... 196 15 392.1

[51] Int. Cl.[6] ..... A63B 22/06

[52] U.S. Cl. ..... 482/57; 482/908; 482/142

[58] Field of Search ..... 482/142, 51, 52, 482/57, 95, 96, 900, 4, 908; 280/287

[56] References Cited

U.S. PATENT DOCUMENTS

| | | | |
|---|---|---|---|
| 2,320,489 | 6/1943 | Turner et al. . | |
| 4,244,021 | 1/1981 | Chiles, III | 482/900 |
| 4,285,515 | 8/1981 | Gezari | 482/57 |
| 4,436,097 | 3/1984 | Cunningham . | |
| 4,577,860 | 3/1986 | Matias | 482/57 |
| 4,817,938 | 4/1989 | Nakao | 482/900 |
| 5,207,623 | 5/1993 | Thatchouk | 482/900 X |
| 5,312,311 | 5/1994 | Pearson . | |
| 5,342,261 | 8/1994 | Johnston . | |
| 5,342,265 | 8/1994 | Creelman et al. . | |
| 5,342,269 | 8/1994 | Huang | 482/96 X |
| 5,549,527 | 8/1996 | Yu | 482/95 X |
| 5,672,141 | 9/1997 | Johnston | 482/57 |

FOREIGN PATENT DOCUMENTS

| | | |
|---|---|---|
| 397 033 | 1/1994 | Austria . |
| 2036818 | 12/1970 | France . |
| 1054204 | 9/1959 | Germany . |
| 2408674 | 8/1975 | Germany . |
| 301322 | 12/1992 | Germany . |
| 4203917 | 8/1993 | Germany . |
| 9307352 U | 8/1993 | Germany . |

OTHER PUBLICATIONS

J.M.H. Cabri, "Isokinetische Bewegungen als Diagnose– und Rehabilitationsprinzip," Med. Orth. Tech. 114, (1994), pp. 177–181.

G. Eissing, "Eicheinrichtung fur Fahrradergometer," Biomed. Tech. 27 (1982), pp. 84–86.

G. Seibert et al., "Isokinetische Systeme –Funktionsprufung und Kalibrierung," Madizintechnik 111 Jg. May 1991, pp. 165–172.

*Primary Examiner*—Richard J. Apley
*Assistant Examiner*—William LaMarca
*Attorney, Agent, or Firm*—Leydig, Voit & Mayer, Ltd.

[57] ABSTRACT

The invention relates to an ergometric stationary bicycle apparatus which is suitable for training, rehabilitation and diagnostic purposes. The apparatus comprises a base member, a pedal unit arranged on the base and including a hub which is rotatable about a pedal unit axis, and a carrier element connected to the base such that it can pivot relative to the base about an axis parallel to the pedal unit axis. The apparatus also includes a seat unit pivotally connected to the carrier element such that the seat unit and the carrier element may be selectively adjusted into different pivot positions. The pivot axis of the carrier element is disposed proximate the pedal unit axis so that the average distance between the seat surface and the pedal unit axis is essentially equal in the different pivot positions of the carrier element.

21 Claims, 2 Drawing Sheets

ERGOMETRIC STATIONARY EQUIPMENT SUITABLE FOR TRAINING, DIAGNOSTIC OR REHABILITATION PURPOSES

FIELD OF THE INVENTION

The present invention relates generally to a training, diagnostic and rehabilitation apparatus, and more particularly to ergometric stationary equipment suitable for training and for diagnostic or rehabilitation purposes.

BACKGROUND OF THE INVENTION

Ergometric stationary bicycles are often used for conventional training purposes, however, they may also be used in more of a medical context for diagnostic and rehabilitation purposes. The training, diagnostic and rehabilitation capabilities of an ergometric stationary bicycle may be significantly enhanced if the stationary bicycle allows a user to exercise his or her leg muscles in a variety of different ways. One way in which this can be accomplished is by designing the ergometric stationary bicycle such that the angular position of the bicycle seat relative to the foot pedals may be selectively adjusted.

A stationary bicycle which includes a seat unit which is pivotal relative to the foot pedals is disclosed in DE 30 42 087 A1. The disclosed stationary bicycle includes a seat-armrest unit which is attached to a carrier element. The carrier element is pivotally connected to a base frame of the stationary bicycle such that the pivot axis of the carrier is located some distance behind the foot pedal unit on the base frame. When the stationary bicycle is in use, the carrier may be fixed in a certain position and then the seat-armrest unit may be slidably adjusted along the carrier. In the event of a medical emergency (for example the user fainting), the carrier may be pivoted into a substantially horizontal position. Since the pivot axis of the carrier is not positioned close to the foot pedal unit, when the carrier is pivoted, the distance between the seat-armrest unit and the foot pedals varies. This requires an adjustment of the seat along the carrier.

DE 42 03 917 C2 also discloses an ergometric stationary bicycle in which the angle of the seat-armrest unit relative to the bicycle pedals is adjustable into various positions in which the seat-armrest unit may be set. In addition, the distance between the seat-armrest unit and the foot pedal unit remains constant when the angle of the seat-armrest unit is being adjusted. However, the drive mechanism and the associated power transmission mechanism are costly to design and manufacture because these parts along with the foot pedal unit are arranged on or in the interior of a carrier system pivotally mounted on the frame of the stationary bicycle. Similarly, the stationary bicycle disclosed in U.S. Pat. No. 5,342,261 is difficult and costly to design and manufacture because the foot pedal unit together with the various units which are actuated by the foot pedal unit are arranged on a carrying body which is pivotally attached to the frame of the stationary bicycle.

DE-OS 20 21 130 discloses an ergometric stationary bicycle in which a seat-armrest unit is vertically adjustable and fixable with respect to a carrier, which itself is adjustable and fixable horizontally with respect to the frame. However, the carrier is not pivotally attached to the frame. Accordingly, whenever the elevational position of the seat-armrest unit is changed, the position of the seat-armrest unit on the carrier must be adjusted in order to maintain the same distance between seat-armrest unit and the foot pedal unit.

Further examples of equipment of this general type include DE 44 19 307 A1 which discloses a ergometric stationary bicycle for use in the medical field which includes a hysteresis brake arrangement. Additionally, EP 0 403 295 A1 discloses a foldable exercise bike having a fixed use position and a foot pedal unit which is rigidly fastened to the carrier. U.S. Pat. No. 4,700,946 discloses a training apparatus which permits an arm and leg musculature movement against the very body weight of the user. This is accomplished by way of a seat slide which is arranged on inclined parallelogram rails and is by suspension drive-off force pressed against a support for the arms and legs of the user. The device can also be used as a bicycle trainer, in which case the seat slide rests in its lowest position.

EP 0 188 617 B1 discloses a so-called isokinetic, or motor-driven, ergometric stationary bicycle in which the foot pedal unit is mounted on a carrying body which is pivotally and fixably connected to a base plate which contains the drive motor together with the associated force transmission mechanism. As with many of previously discussed devices, the disclosed apparatus is very costly to manufacture. The cost of this stationary bicycle is magnified even further by that fact that a required feed line from an energy source is routed through the pivot joint to the motor.

Another isokinetic apparatus is disclosed in U.S. Pat. No. 5,033,736 in which in which a wheelchair can be driven up to the apparatus, however, adjustment of the apparatus is not possible.

OBJECTS AND SUMMARY OF THE INVENTION

Accordingly, a primary object of the present invention is to overcome the deficiencies of existing ergometric stationary equipment.

Another object of the present invention is to provide an ergometric stationary piece of equipment which is suitable for training, diagnostic and rehabilitation purposes.

An additional object of the present invention is to provide an ergometric stationary piece of equipment which has a seat unit which is adjustable such that it may be placed in various angular positions relative to the bicycle pedals and which has a relatively simple and cost-efficient design.

A related object of the present invention is to provide an ergometric stationary piece of equipment which has a seat unit which remains approximately the same distance from the pedals when the seat unit is adjusted into different positions relative to the bicycle pedals.

The present invention provides these and other features and advantages with an ergometric stationary piece of equipment which includes a base member, a pedal unit arranged on the base and including a hub which is rotatable about a pedal unit axis, and a carrier element connected to the base such that it can pivot relative to the base about an axis parallel to the pedal unit axis. The equipment also includes a seat unit pivotally connected to the carrier element such that the seat unit and the carrier element may be selectively adjusted into different desired pivot positions. The pivot axis of the carrier element is disposed proximate the pedal unit axis so that the average distance between the seat surface and the pedal unit axis is within a desired range in the different pivot positions of the carrier element.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DESCRIPTION OF THE PREFERRED EMBODIMENTS

Generally, the present invention relates to an ergometric stationary piece of equipment having a relatively simple design which allows the angular position of the seat unit relative to the foot pedals to be selectively adjusted in order to allow a user to work different groups of his or her leg muscles. Moreover, the seat unit remains at approximately the same distance from the foot pedals when the seat element is adjusted into the various angular positions. Therefore, there is no need for a user to readjust the position of the seat unit each time he or she varies its angular position. In addition, the manner in which the user's muscles are worked may be varied. Accordingly, the ergometric stationary equipment piece of the present invention is well suited for a variety of applications including training, diagnostic and rehabilitation purposes.

Figure 1:
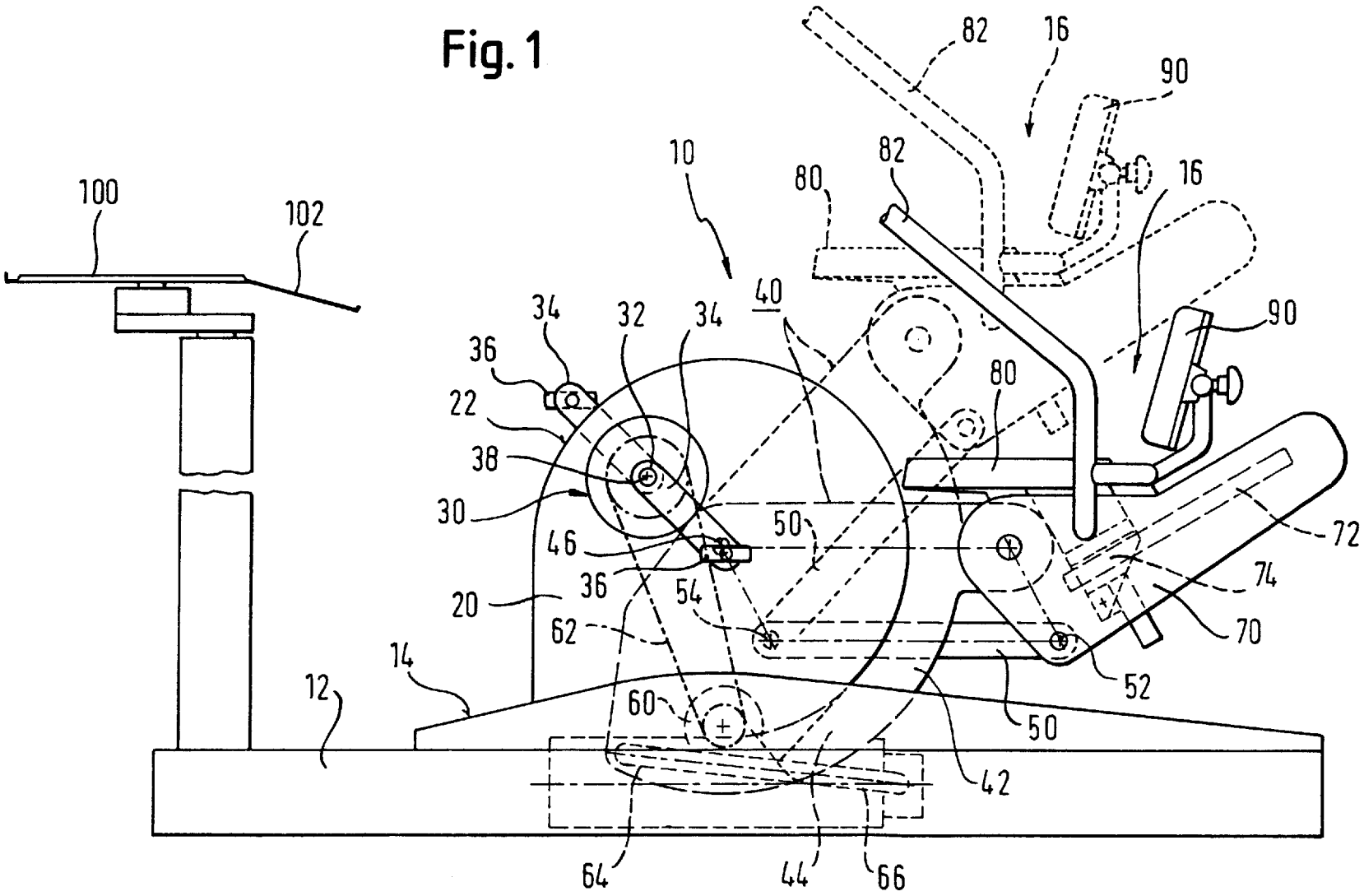
FIG. 1 is a side elevation view of one embodiment of an ergometric stationary piece of equipment according to the present invention.
Figure 2:
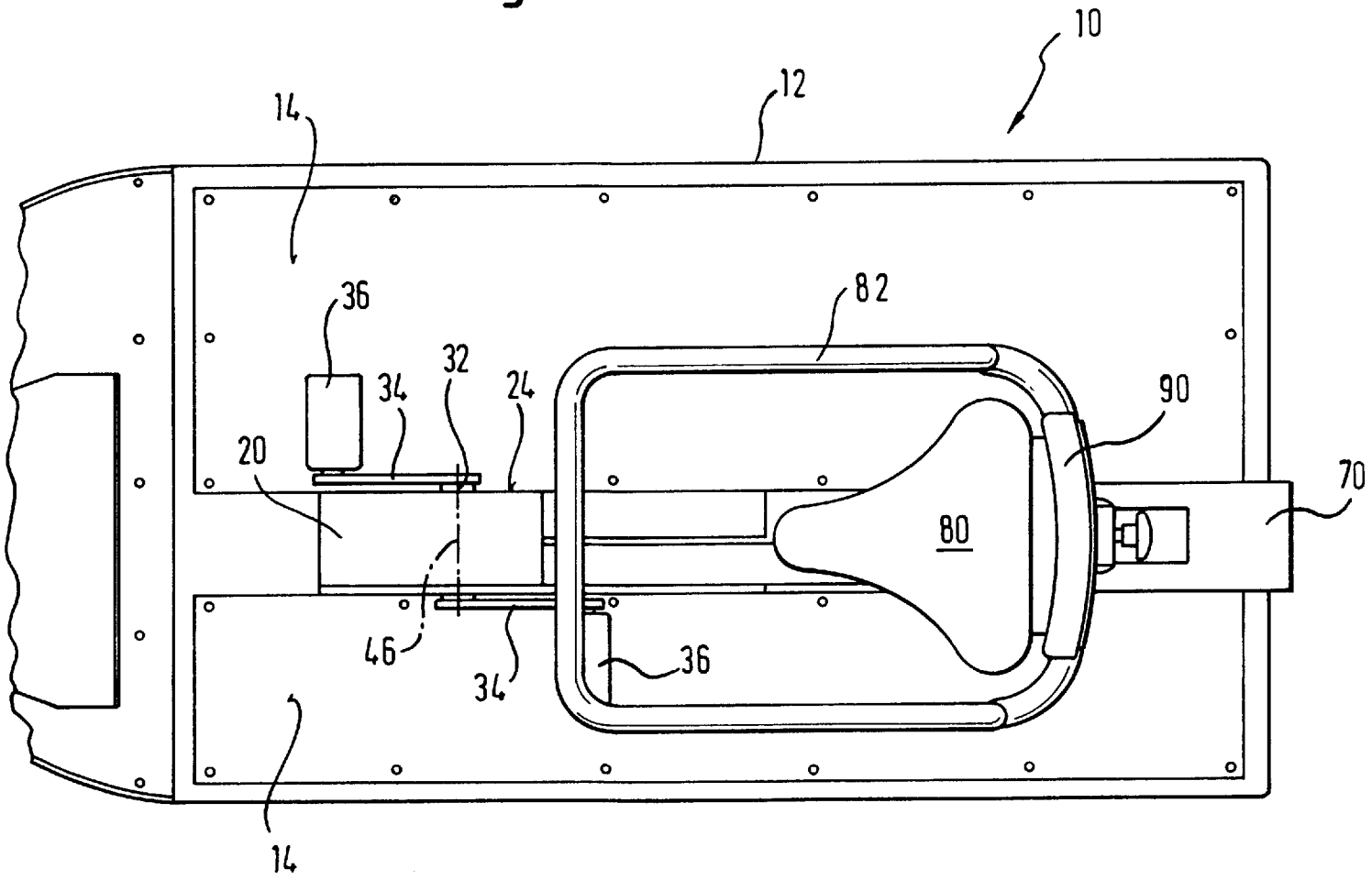
FIG. 2 is a plan view of the ergometric stationary piece of equipment of FIG. 1.

FIGS. 1–2 illustrate an ergometric stationary piece of equipment or bicycle 10 constructed in accordance with one embodiment of the present invention. As shown in FIG. 1, the stationary bicycle includes a base member 12 which has a flat, roughly slab-shaped hollow base part and a slightly upward-arched cover surface 14 which comprises a plurality of removable plates. The upper portion of the base member 10 continues into a disk-shaped housing 20 which has a circumferential surface 22 and a planar surface 24 and on which a foot pedal unit 30, a carrier element 40 and a guide arm 50 are mounted as described in more detail below.

In order to permit the appropriate pedaling action, the stationary bicycle 10 includes a foot pedal unit 30. As best shown in FIG. 1, the foot pedal unit includes foot pedals 36 which are connected via lever arms 34 to a bearing hub 32 which is rotatably supported in or on the disk-shaped housing 20. The resistance or the power for the pedaling action is provided by a drive mechanism 60 which is disposed on the base member 12. The drive mechanism 60, which in a preferred embodiment comprises an electric motor, may act in various modes as either a brake or a drive motor, as desired, depending on whether the stationary bicycle apparatus of the present invention is being operated as a typical ergometric stationary bicycle or as a so-called isokinetic bicycle simulator.

When the stationary bicycle 10 is being operated as an isokinetic bicycle simulator, the pedals 36 are driven externally over a transmission 62 which allows for force-free movement training of the leg musculature. The user, however, may also try to move the pedals 36 faster or slower than the speed at which they are turned by the external drive mechanism 60. If an external drive mechanism delivers a constant turning rate to the foot pedal unit, the user can exert braking or accelerating forces at a constant speed. In contrast, in a situation where a drive mechanism delivers a constant torque to the foot pedal unit 30, the user can accelerate or retard the rotary movement of the pedals within a certain speed range. The drive mechanism 60 also may be adapted such that the turning rate and turning direction provided are adjustable. The drive mechanism 60 may also be arranged such that an increase or decrease of the pedal turning rate brought about by the user is accompanied by a corresponding decrease or increase of the torque opposing this movement, particularly in such manner that the performance provided by the user remains substantially constant. Likewise, the drive mechanism 60 may be arranged such that an increase or decrease of the torque applied to the pedals by the user is accompanied by a corresponding increase or decrease in the pedal turning rate brought about by the drive mechanism 60. Thus, the ergometric stationary bicycle of the present invention has the advantage that the user delivers work under controlled kinematic conditions. This enables the stationary bicycle 10 to be used in certain applications, such as for example in medical rehabilitation processes, wherein a continuously heightened and simultaneously monitored training program is desirable.

In order to provide for pivotal movement of the seat unit of the stationary bicycle apparatus relative to the foot pedal unit 30, the stationary bicycle apparatus includes a carrier element 40. As shown in FIG. 1, one end of the carrier element 40 is pivotally connected to the disk-shaped housing 20 in the area between the bearing hub 32 and the center of the housing 20. Accordingly, the pivot axis 46 of carrier element 40 is located proximate the bearing hub 32. In an alternative embodiment, the pivot axis 46 of the carrier element 40 may be located in the bearing hub 32. A seat unit 16 is borne on the opposing end of the carrier element 40. The seat unit 16 is adjustable relative to the carrier element 40, as discussed in greater detail below.

The arrangement of the carrier element pivot axis 42 "proximate" the foot pedal unit 30, as used herein, means that the distance between the pivot axis of the carrier element and the axis 38 of the foot pedal unit is preferably less than 30%, and more preferably less than 20% of the average distance between the surface of the seat and the axis of the foot pedal unit. The distance between the surface of the seat and the axis 38 of the foot pedal unit preferably refers to the distance between a certain point of the seat surface in an essentially horizontal seat surface position and the foot pedal unit axis 38.

The pivot angle of the carrier element 40 is selected in such a way that a movement from the usual sitting position (shown in broken lines in FIG. 1) into a quasi-recumbent position (shown in solid lines in FIG. 1) is possible. This enables different groups of muscles to be trained depending on whether the seat unit 16 is set in a high or low position. However, since the pivot axis 46 of the carrier element 40 is located proximate the foot pedal unit 16, the average distance between the seat unit 16 and the axis 38 of the foot pedal unit 30 remains substantially equal in all of the various pivot positions of the carrier element 40 relative to the disk-shaped housing 20. The statement that the average distance remains "substantially equal" as used herein is intended to mean that the difference between the greatest distance and the least distance occurring from the seat surface to the axis 38 of the foot pedal unit is preferably less than 20% and more preferably less than 10% of the average distance apart.

In order to allow for an easy and stageless adjustment of the carrier element 40 for the seat unit 16 into the desired position, the stationary bicycle 10 is equipped with a carrier drive mechanism. In the illustrated embodiment, the carrier drive mechanism includes a rocker arm 42 which projects from the carrier element 40 at an angle, the form of which is adapted to the circumferential surface 22 of the disk-shaped housing 20. The free end 44 of the rocker arm 42 is articulately joined with a motor-operated tie rod gear 64 via a pinion 66 in such manner that the longitudinal movements of the pinion 66 are transformed into the pivoting movement of the carrier element 40. In a preferred embodiment, the tie rod gear 64 may be driven by the drive mechanism 60. When the tie rod gear is at rest, it serves as a fixing device for the carrier element 40. As shown in FIG. 1, the tie-rod gear 64 together with the associated pinion 44 is located within the base 12 of the stationary bicycle 10. In order to provide for quick and easy adjustment of the carrier element 40, the tie rod gear and pinion mechanism may be actuated by a hand lever or the like. Those skilled in the art will appreciate that other mechanisms may be employed for driving the adjustment of the carrier element including allowing for manual adjustment of the position of the carrier element.

In order to retain the bicycle apparatus to be adjusted for users of different heights, the position of the seat unit 16 is selectively adjustable in the longitudinal direction of the carrier element 40. Specifically, in the illustrated embodiment, the seat unit 16 includes an extension member 70 which is interposed in such manner that it is articulated on the carrier element 40 and carries the components of the seat unit 16. In order to allow for adjustment of the distance between the seat unit 16 and the pedals 36 according to the size of the user, the extension member 70 includes guides 72 which enable longitudinal displacement of the seat unit 16. The extension member 70 includes an elevation adjustment device 74 which enables adjustment of the distance between the seat surface 80 of the seat unit 16 and the extension member 70. The elevation adjustment device 74 also acts as a fixing device for the longitudinal and height adjustment of the seat unit. In addition, the seat unit 16 may include a backrest 90 which may be pivoted and then fixed into various positions with respect to the seat surface 80. This feature is particularly useful when the user is in the quasi-recumbent position. Further, the seat unit 16 may include pivotable and fixable arm rests 82, which contribute to a secure sitting or lying position of the user.

In order to hold the seat surface 80 at the same inclination in the various pivot positions, the ergometric stationary bicycle of the present invention may include a mechanism for maintaining a constant inclination of the seat unit. According to one preferred embodiment, this constant inclination maintenance mechanism comprises a parallelogram-type guide linkage. Specifically, in addition to being connected to the carrier element 40, the extension member 70 is further joined at 52 with one end of a guide 50, which in the illustrated embodiment is in rod form. The opposing end of the guide member 50 is pivotally connected at 54 to the disk-shaped housing 20. The dimensions of the guide member 50 and the two articulation points 52, 54 are chosen such that the guide member 50, the carrier element 40, the housing 20 and the extension element 70 form a parallelogram linkage. This parallelogram linkage ensures that in all pivoting positions of the carrier element 40 the seat surface 80 of the seat unit 16 remains in the horizontal position. This feature is particularly important for the safety of the user during the operation of the device. Alternatively, an active drive, for example an electric motor, can be provided which after each change in the pivot position of the carrier element 40 brings up the inclination of the seat surface 80 in such manner that it remains constant and independent from the inclination of the carrier element. Of course, those skilled in the art will appreciate that other methods for maintaining a constant inclination of the seat unit may be used.

The ergometric stationary bicycle of the present invention may also be equipped with biofeedback equipment 100. The biofeedback equipment 100 enables the working functions and performance characteristics of the apparatus (e.g., turning rate and/or torque) and/or of the user (e.g., blood pressure, pulse rate, and/or provided torque) to be provided and monitored, for example with a computer, and displayed on a display screen 102. The biofeedback equipment may also provide instructions to the user that he is to achieve certain values relating to the user's kinematic or physical performance characteristics. For example, when the stationary bicycle 10 is operating in a constant torque mode, the biofeedback equipment could signal that the user should achieve a higher turning rate. These predetermined values can also vary over in time, they may, for instance, periodically increase or decrease.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. An ergometric stationary piece of equipment comprising:

a base member, a pedal unit arranged on the base member including a hub which is rotatable about a pedal unit axis, a carrier element connected to the base member such that it can pivot relative to the base about an axis parallel to the pedal unit axis, and a seat unit pivotally connected to the carrier element such that the seat unit and the carrier element may be selectively adjusted into different pivot positions, the seat unit including a seat surface, the pivot axis of the carrier element being proximate the pedal unit axis so that the difference between the greatest distance and the least distance occurring from the seat surface to the pedal unit axis is less than ten percent of the average distance between the seat surface and the pedal unit axis in the different pivot positions of the carrier element, and a mechanism for maintaining a constant inclination of the seat surface relative to the base when the carrier element pivots into different positions, the seat surface inclination maintenance mechanism comprising a parallelogram linkage including the carrier element and a guide member which is pivotally connected to the base member and the seat unit.

2. The invention according to claim 1, further comprising a drive motor, a linear drive actuatable by the drive motor and including a pinion, and a rocker arm attached to the carrier element which cooperates with the pinion such that linear movements of the pinion cause the carrier element to pivot relative to the base member.

3. The invention according to claim 2 wherein the drive motor is controlled such that when the position of the carrier element is being adjusted the carrier element pivots continuously.

4. The invention according to claim 1, wherein the seat unit is selectively adjustable longitudinally with respect to the carrier element and is securable in a selected position by means of a fixing device.

5. The invention according to claim 4 wherein the seat unit includes an extension member which includes at least one guide for the selective adjustment of the seat unit relative to the carrier element.

6. The invention according to claim 5 wherein the extension member further includes a device for selectively adjusting the distance between the seat surface and the extension member.

7. The invention according to claim 1 wherein the seat unit includes an armrest which is selectively pivotable with respect to the seat surface.

8. The invention according to claim 1, wherein the base member continues into a disk-shaped housing and the carrier element is pivotally connected in the center of the disk-shaped housing.

9. The invention according to claim 2 wherein the linear drive and the drive motor are disposed on the base part and are covered by removable plates.

10. The invention according to claim 1 wherein the pedal unit is selectively driven by a drive mechanism having an selectively adjustable turning rate and/or turning direction and wherein the drive mechanism is arranged such that a user can supply a torque on the pedal unit either in the turning direction or against the turning direction of the pedal unit.

11. The invention according to claim 10 wherein the drive mechanism provides a constantly maintained turning rate to the pedal unit.

12. The invention according to claim 10 wherein the drive mechanism provides a constantly maintained torque to the pedal unit.

13. The invention according to claim 10 wherein the drive mechanism provides a decreased torque to the pedal unit to oppose an increase of the turning rate of the pedal unit brought about by the user and the drive mechanism provides an increased torque to the pedal unit to oppose a decrease of the turning rate of the pedal unit brought about by the user.

14. The invention according to claim 10 wherein the drive mechanism provides a decreased torque to the pedal unit to oppose an increase of the turning rate of the pedal unit brought about by the user and the drive mechanism provides an increased torque to the pedal unit to oppose a decrease of the turning rate of the pedal unit brought about by the user such that the performance provided by the user remains substantially constant.

15. The invention according to claim 1 further comprising a biofeedback device for measuring, retaining and displaying at least one preselected performance characteristic of the piece of equipment.

16. The invention according to claim 15 wherein the biofeedback device displays a value of the preselected performance characteristic of the piece of equipment which is to be achieved by the user.

17. The invention according to claim 1 further comprising a biofeedback device for measuring, retaining and displaying at least one preselected performance characteristic of a user.

18. The invention according to claim 17 wherein the biofeedback device displays a value of the preselected performance characteristic of the user which is to be achieved by the user.

19. An ergometric stationary piece of equipment comprising:

a base member, a pedal unit arranged on the base member including a hub which is rotatable about a pedal unit axis, a carrier element connected to the base member such that it can pivot relative to the base about an axis parallel to the pedal unit axis, and a seat unit pivotally connected to the carrier element such that the seat unit and the carrier element may be selectively adjusted into different pivot positions, the seat unit including a seat surface, the pivot axis of the carrier element being proximate the pedal unit axis so that the difference between the greatest distance and the least distance occurring from the seat surface to the pedal unit axis is less than ten percent of the average distance between the seat surface and the pedal unit axis in the different pivot positions of the carrier element, and a drive motor, a linear drive actuatable by the drive motor and including a pinion, and a rocker arm attached to the carrier element which cooperates with the pinion such that linear movements of the pinion cause the carrier element to pivot relative to the base member.

20. The invention according to claim 19 wherein the drive motor is controlled such that when the position of the carrier element is being adjusted the carrier element pivots continuously.

21. The invention according to claim 19 wherein the linear drive and the drive motor are disposed on the base part and are covered by removable plates.

* * * * *